US006769564B2

(12) United States Patent
Prestele

(10) Patent No.: US 6,769,564 B2
(45) Date of Patent: Aug. 3, 2004

(54) BREECH FOR DUAL COMPONENT CARTRIDGE WITH A MANUAL-DETACHABLE SNAP-IN CONNECTION

(75) Inventor: Eugen Prestele, Augsburg (DE)

(73) Assignee: Sulzer Chemtech AG, Winterthur (CH)

( * ) Notice: Subject to any disclaimer, the term of this patent is extended or adjusted under 35 U.S.C. 154(b) by 88 days.

(21) Appl. No.: 10/103,662

(22) Filed: Mar. 21, 2002

(65) Prior Publication Data

US 2002/0153377 A1 Oct. 24, 2002

(30) Foreign Application Priority Data

Apr. 12, 2001 (DE) ..... 201 06 406 U

(51) Int. Cl.[7] ..... B65D 41/04

(52) U.S. Cl. ..... 220/288; 215/320; 215/276; 215/274; 220/319; 220/281; 222/483; 222/153.01

(58) Field of Search ..... 215/211, 213, 215/216, 356, 364, 329, 320, 276, 274, 305; 222/153.01, 483–485, 489; 220/256.1, 254.7, 254.9, 255, 288, 319, 281

(56) References Cited

U.S. PATENT DOCUMENTS 4,480,762 A * 11/1984 Thomas ..... 215/273
4,676,393 A * 6/1987 Daniel ..... 220/323
4,974,756 A * 12/1990 Pearson et al. ..... 222/562
5,137,182 A * 8/1992 Keller ..... 222/153.1
5,482,177 A 1/1996 Keller
5,575,398 A * 11/1996 Robbins, III ..... 220/8
5,723,013 A * 3/1998 Jeanson et al. ..... 623/17.16
6,439,409 B1 * 8/2002 Dressel et al. ..... 215/228
6,619,495 B1 * 9/2003 Pares Montaner et al. .. 215/272
2003/0029887 A1 * 2/2003 Pennaneac'h et al. ... 222/383.1

FOREIGN PATENT DOCUMENTS

DE 89 15 637 U1 11/1990
FR 2 462 354 A1 2/1981

* cited by examiner

*Primary Examiner*—Robin A. Hylton
(74) *Attorney, Agent, or Firm*—Martin Fleit; Paul D. Bianco; Fleit Kain Gibbons Gutman Bongini & Bianco, P.L.

(57) ABSTRACT

A breech for a dual-component cartridge with a breech plug with two sealing bolts which can be inserted into the two mutually separated outlet openings at the cartridge throat and seal these openings tightly, and with a retaining nut that can be screwed onto the cartridge throat. This nut can turn relative to the breech plug and can be locked to it in an axial direction and released therefrom. In order that the breech plug will be held by the retaining nut without additional parts and so that it can again be easily separated from it, between the retaining nut and the breech plug a manual-detachable snap-in connection is formed by the relative movement of the breech plug in the axial direction.

6 Claims, 2 Drawing Sheets

BREECH FOR DUAL COMPONENT CARTRIDGE WITH A MANUAL-DETACHABLE SNAP-IN CONNECTION

BACKGROUND OF THE INVENTION

1. Field of the Invention

The invention pertains to a breech for a dual-component cartridge.

2. Prior Art

The subject of the invention is concerned with two, mutually separated, semi-circular shaped or circular-segmented outlet openings at the cartridge throat of a cartridge. To make a tight seal of these outlet openings, breech plugs are used with two sealing bolts that are inserted into the outlet openings.

In a first design embodiment, the inserted breech plug is covered by a cap screwed onto the cartridge throat. For opening, the cap is screwed off and the breech plug is withdrawn from the outlet openings. The extraction of the breech plug from the cartridge is exceptionally troublesome and associated with a large force requirement, due to the necessary rigid seat. Preferably, static mixers with molded on threading are screwed onto the cartridge throat. If a mixer with chalice adapter is used, then an additional retaining nut is needed.

In an additional, known design embodiment, first the retaining nut is screwed on, and then the breech plug is pressed into the outlet openings through the opening in the retaining nut. The upper end of the breech plug extends over the opening of the retaining nut. When unscrewing the retaining nut from the cartridge, the breech plug is pulled out of the cartridge and can then be removed from the retaining nut. The disadvantage of this design is that the breech plug is not held by the retaining nut, i.e., it is not pressed into the cartridge and thus it can be pressed out due to the generation of heat caused by the internal pressure generated in the cartridge.

In another known breech, whose properties form the upper clause of claim 1, the upper end of the breech plug extends through the screwed on retaining nut and has a ring-shaped recess there. A slotted metal washer is inserted into this recess. If the retaining nut is unscrewed from the cartridge, then the breech plug can be pulled out from the outlet openings of the cartridge by means of the metal washer. In order that the retaining nut can be used to screw on a mixer with chalice adapter, the lock between the breech plug and the retaining nut must be detached by removal of the metal washer. It is then either discarded or preserved in the event that the lock is to be restored.

The problem still exists to design the breech so that the breech plug will be held by the retaining nut without additional parts, and the breech plug can be easily separated from the retaining nut.

SUMMARY OF THE INVENTION

This problem note above is solved by the present invention. According to the invention, a breech for a dual-component cartridge is provided having a breech plug with two sealing bolts which can be inserted into the two mutually separated outlet openings at the cartridge throat and which seal these openings tightly, and with a retaining nut that can be screwed onto the cartridge throat. Said nut can turn relative to the breech plug (7) and can be locked to it in an axial direction and released therefrom. The breech is characterized in that between the retaining nut and the breech plug a manual-detachable snap-in connection is formed by the relative movement of said breech plug in the axial direction.

The breech as described above is characterized in that the snap-in connection has two legs at the breech plug that running roughly parallel to the axis and protrude from an opening of the retaining nut. These legs can be locked with the retaining nut featuring a perimeter snap-in part and can be released from it by compression of the legs. The breech can be further characterized in that the perimeter snap-in part of the retaining nut is a snap-in hub which engages in snap recesses of the legs. The legs can run roughly as an extension of the sealing bolts. Above the snap-in recesses, the legs each have a ramp running at a slant in the direction of the snap-in recesses. The snap-in hub is wedge-shaped, and the wedge peak points upward together with the bevel adjoining below. A shoulder is joined to the bevel and comes to rest against the shoulder bounding the snap-in recess.

Other and further objects and advantages of the present invention will become readily apparent from the following detailed description of a preferred embodiment of the invention when taken in conjunction with the appended drawings.

BRIEF DESCRIPTION OF THE DRAWINGS

One design embodiment of the invention will be explained in greater detail below, with reference to the figures, in which.

DETAILED DESCRIPTION OF A PREFERRED EMBODIMENT

Figure 2:
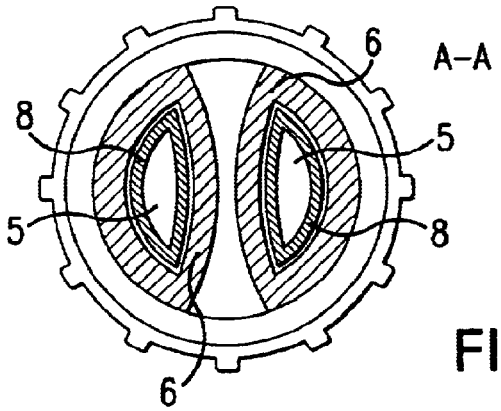
FIG. 2 shows a cross section along the line A—A in FIG. 1.
Figure 1:
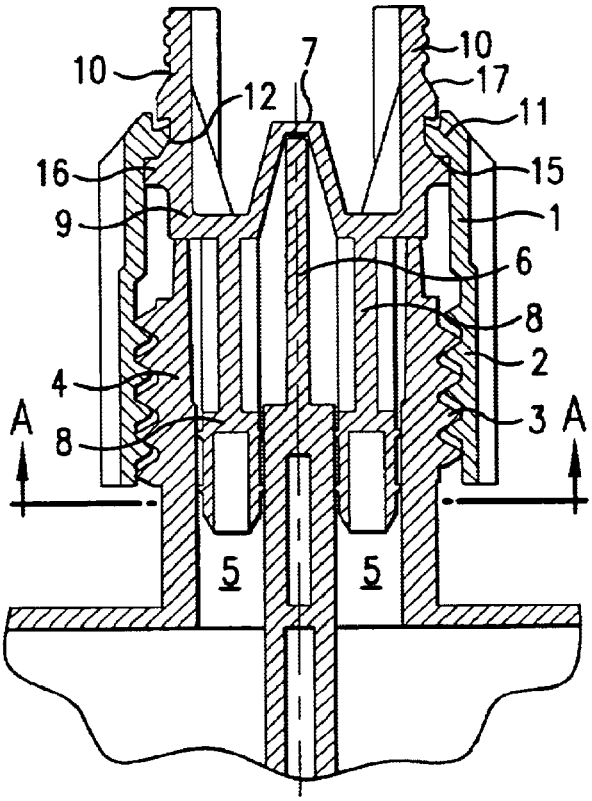
FIG. 1 illustrates a vertical cross section through the breech.
Figure 4:
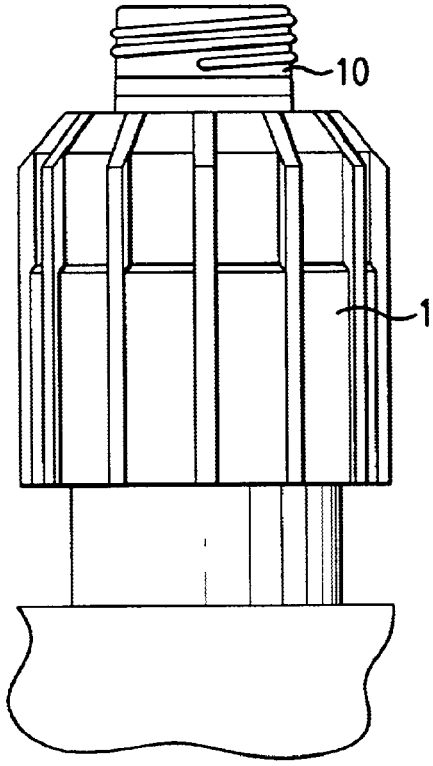
FIG. 4 shows a side view of the breech.
Figure 3:
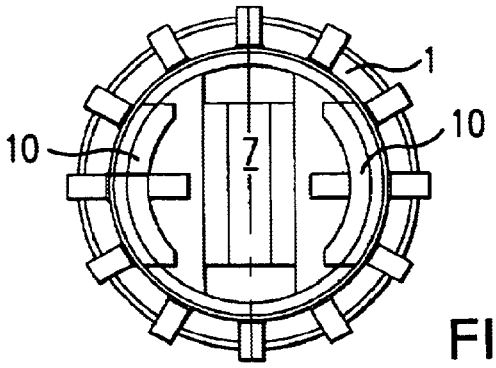
FIG. 3 shows a top view of the breech.
Figure 5:
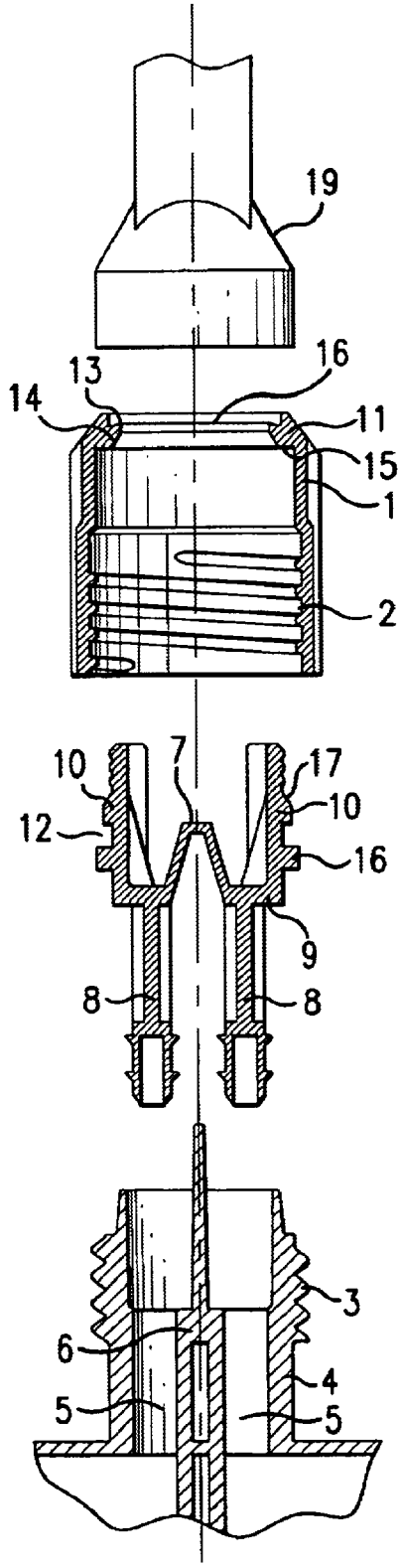
FIG. 5 shows an exploded illustration of the parts of the breech with a static mixer with chalice adapter.

As shown in the several figures of the drawing, the breech has a retaining nut 1 which is equipped with internal threading 2, so that the retaining nut can be screwed onto and from the outer threading 3 of the cartridge neck 4. The cartridge neck 4 has two half-moon shaped outlet openings 5 which are separated from each other by separating walls 6.

Furthermore, the breech has a breech plug 7 that is composed of two sealing bolts 8 which can be inserted into the outlet openings to seal them tightly. The breech plug 7 has a radial shoulder 9 that comes to rest against the upper edge of the cartridge neck 4 and thus limits the insertion depth of the sealing bolt 8.

Adjoining the shoulder 9 there are two legs 10 which run parallel to the center axis and which protrude past the opening 18 of the retaining nut 1. At the upper end of the retaining nut 1 there is a molded on, perimeter snap-in hub 11 which extends to the inside. This snap-in hub 11 engages in snap-in recesses 12 of the leg 10. The snap-in hub has a wedge-like design, and the wedge peak 13 points upward and is joined below by the slanting surface 14 and is followed by a radially running shoulder 15.

The snap-in recess 12 is bounded on the bottom by a radially running shoulder 16. Above the snap-in recesses 12 there is a molded-on, slanting ramp 17.

To connect the retaining nut 1 to the breech plug 7, the plug is pressed from the threaded side of the retaining nut 1 through the opening 18 of the retaining nut 1, until the snap-in hub 11 snaps into the breech recess 12. The breech plug 7 can also be inserted into the outlet openings 5, whereupon the retaining nut 1 will be screwed on until the snap-in hub 11 engages in the snap-in recesses 12.

If the connection between the retaining nut 1 and the breech plug 7 is to be released, then the legs 10 will be pressed together against each other, whereupon then the lock between the retaining nut 1 and the breech plug 7 will be released. After removal of the breech plug 7 from the outlet openings 5, the retaining nut 1 can be used for attachment of a static mixer 19 to the cartridge neck.

Although the invention has been described in terms of a specific preferred embodiment, nevertheless changes and modifications are will be apparent to those of ordinary skill in the art which do not depart from the spirit, scope and contemplation of the invention. Such changes and modifications are deemed to fall within the purview of the invention as claimed.

What is claimed is:

1. In a breech for a dual-component cartridge with a breech plug with two sealing bolts which can be inserted into two mutually separated outlet openings at a cartridge throat and which seal these openings tightly, and with a retaining nut that can be screwed onto the cartridge throat, said nut can turn relative to the breech plug and can be locked to the breech plug in an axial direction and released therefrom, the improvement wherein between the retaining nut and the breech plug there is provided a manual-detachable snap-in connection formed by the relative movement of said breech plug in the axial direction, wherein the snap-in connection has two legs at the breech plug running roughly parallel to an axis and protruding from an opening of the retaining nut, these legs can be locked with the retaining nut having a perimeter snap-in part and can be released from the retaining nut by an inward compression of the legs.

2. In a breech according to claim 1, the improvement in that the perimeter snap-in part of the retaining nut is a snap-in hub that engages in snap recesses of the legs.

3. In a breech according to claim 1, the improvement in that the legs and sealing bolts are a one piece construction, wherein the legs run roughly as an extension of the sealing bolts.

4. In a breech according to claim 2, the improvement in that above the snap-in recesses of the legs each has a ramp running at a slant in the direction of the snap-in recesses.

5. In a breech according to claim 2, the improvement in that the snap-in hub is wedge-shaped, and a wedge peak points upward together with a bevel adjoining below.

6. In a breech according to claim 5, the improvement in that a shoulder is joined to the bevel and comes to rest against the shoulder bounding the snap-in recess.

* * * * *